US007794648B2

(12) United States Patent
Theis et al.

(10) Patent No.: US 7,794,648 B2
(45) Date of Patent: Sep. 14, 2010

(54) TUNDISH CARRIAGE WITH A LIFTING DEVICE FOR A TUNDISH

(75) Inventors: Richard Theis, Senscheid (DE); Hans Juergen Hecken, Schuld (DE)

(73) Assignee: SMS Siemag Aktiengesellschaft, Schaan (LI)

( * ) Notice: Subject to any disclaimer, the term of this patent is extended or adjusted under 35 U.S.C. 154(b) by 499 days.

(21) Appl. No.: 11/886,413

(22) PCT Filed: Dec. 14, 2006

(86) PCT No.: PCT/EP2006/012024

§ 371 (c)(1),
(2), (4) Date: Sep. 12, 2007

(87) PCT Pub. No.: WO2007/087864

PCT Pub. Date: Aug. 9, 2007

(65) Prior Publication Data

US 2008/0185120 A1 Aug. 7, 2008

(30) Foreign Application Priority Data

Jan. 31, 2006 (DE) ..... 10 2006 004 308

(51) Int. Cl.
*B22D 39/04* (2006.01)

(52) U.S. Cl. ..... 266/276; 164/438

(58) Field of Classification Search ..... 266/276; 164/437, 438

See application file for complete search history.

(56) References Cited

U.S. PATENT DOCUMENTS

| | | | | |
|---|---|---|---|---|
| 4,253,790 | A * | 3/1981 | Aberegg et al. | 414/420 |
| 4,678,167 | A | 7/1987 | Lemper | |
| 6,202,735 | B1 | 3/2001 | Rittner | |

FOREIGN PATENT DOCUMENTS

| | | |
|---|---|---|
| DE | 2306095 | 8/1974 |
| EP | 1457282 | 9/2004 |

* cited by examiner

*Primary Examiner*—Scott Kastler
(74) *Attorney, Agent, or Firm*—Abelman, Frayne & Schwab

(57) ABSTRACT

A tundish carriage with a lifting device (1) for a tundish (2) for liquid steel materials, in particular in a multi-strand caster, wherein the tundish (2) is supported, with a possibility to be lifted or lowered, by controlled electromechanical or hydraulic lifting devices (1*a*, 1*b*) on a carriage frame (7), prevents a quadruple arrangement of piston-cylinder units and a complicated synchronization control, with security for personnel and a noticeable simplification of construction, by providing a single vertical support (9) and only two lifting devices (1*a*, 1*b*).

14 Claims, 8 Drawing Sheets

TUNDISH CARRIAGE WITH A LIFTING DEVICE FOR A TUNDISH

Figure 1A:
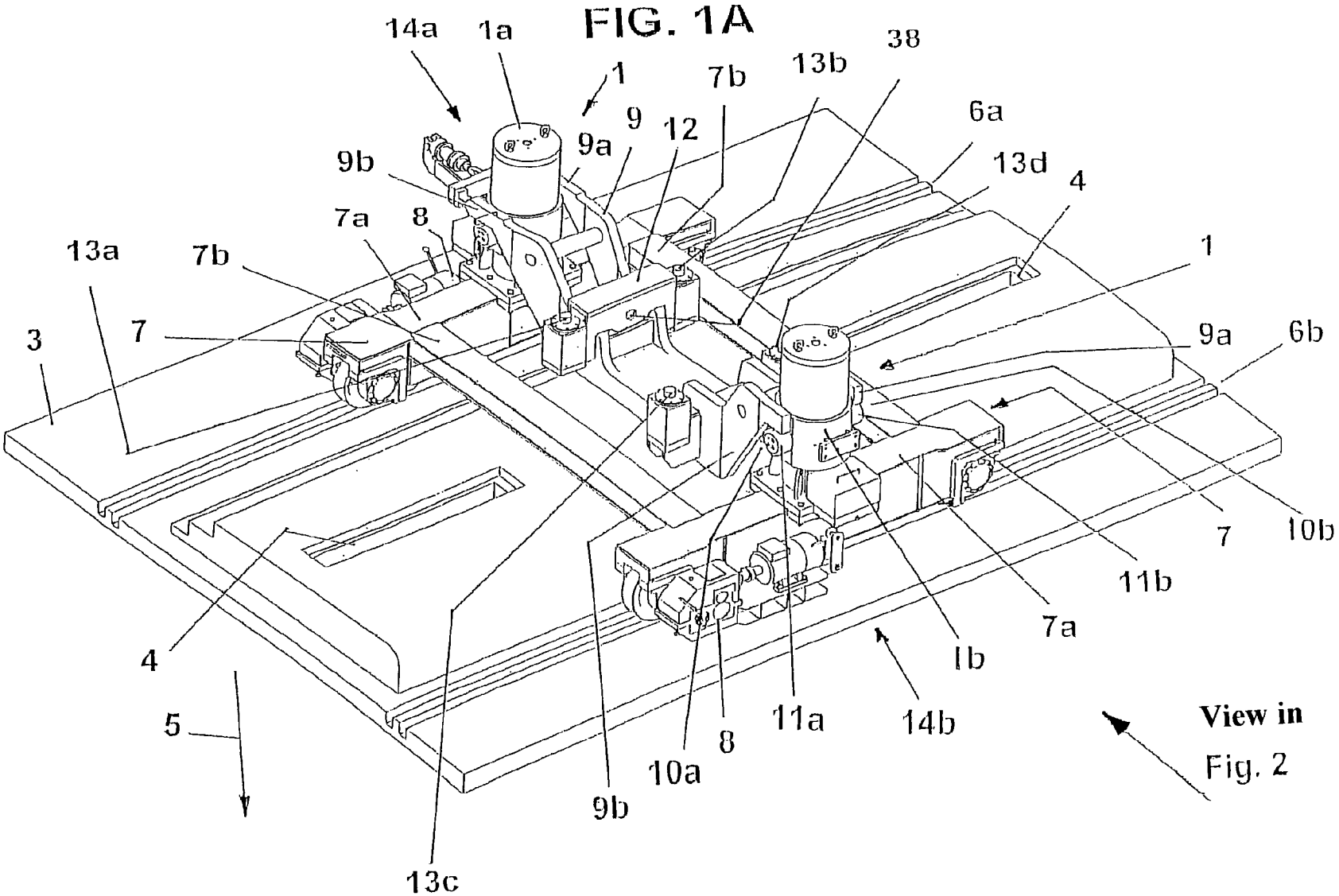

The invention relates to a tundish carriage with a lifting device for a tundish which is displaceable on a teeming platform that is located above a continuous casting mold of a continuous casting machine for a liquid cast metal such as, e.g., a liquid steel material, on a pair or rails and is adjustable, in particular for a multi-strand casters, wherein the tundish is supported, with a possibility of being lifted or lowered, by controllable electromechanical or hydraulic lifting devices on a carriage frame.

Known are tundish carriages with electromechanical (motor-driven spindles), which carry four lifting devices (DE 25 57 769 A1 or EP 0 940 205 B1). The four lifting devices must maintain synchronous movement and be displaceable over the same path. In one of the embodiments, the lifting devices are formed as hydraulic piston-cylinder units which likewise must be displaced synchronously over equal paths. For their control, an expensive synchronization control system is necessary. Upon failure of the synchronization regulation or control system, inclinations of the tundish occur, endangering not only the personnel but also the caster.

The object of the invention to eliminate a fourfold arrangement of the lifting devices and the complicated synchronization regulation and/or control and to achieve an increased security for the personnel, together with the simplification of the construction and reduction of investment costs.

The set object is achieved according to the invention in that the carriage frame, which is provided with displacement drives and running wheels on one or both sides and is formed of longitudinal and cross-beams, contains only one vertical support for the tundish between only two cross-beams, which is supported with respective pairs of arms on arranged in pairs side supports on only two lifting devices which are arranged and secured on respective longitudinal beams of the carriage frame. The advantage consists in that only one pair of hydraulic lifting devices and only one vertical support for the tundish are necessary. The known up to now synchronization regulation is not any more necessary. The simultaneous actuation of the piston-cylinder drives can be effected sufficiently precisely with simpler means.

According to an embodiment of the invention, the supports on the lifting devices are formed of coaxial rollers. This construction noticeably simplifies the design and facilitates the adjustment of the vertical support.

A further improvement consists in that on both lifting devices which are formed by hydraulic piston-cylinder drives, the supports are provided on respective cylinder housings.

It is further provided that a tilting table for the tundish longitudinally displaceably in the vertical support, forms, in the transversely displaceable vertical support, a loose side, and the vertical support has symmetrically arranged pairs of support points for the tundish. Thereby, deformation of the tundish, which occur during an operation, can be compensated. In addition, a symmetrical force application is insured.

Another feature consists in that the tilting table, which is provided in the vertical support on the loose side, is supported in the vertical support at both ends with a springy supports. Thereby, an elastic adaptation of the tundish position after an extended operational period becomes possible.

According to further features, positioning of the tilting table and force transmission for changing the position is effected so that the tilting table is supported on the loose side in the vertical support for pivotal movement about a cross-axle extending parallel to the cross-beams. Thereby, force transmission to the fixed side can be effected with a connection rod.

According to further improvement, of a particular importance is a connection of the two hydraulic lifting devices, instead of a hydraulic synchronization control, by a hydraulic flow divider to a common feeding conduit. This permits to eliminate to a most possible extent the problem of the hydraulic synchronization control, which existed up to the present. With a flow divider, only small tolerances are associated which, in the present case amount to about 2% (synchronization tolerance), and a reliable operation is insured. With recalculation for a stroke of, e.g., 650 mm, the deviation amounts to only 26 mm which, however, proved to be acceptable at calibration in lower and upper positions. In addition, a sufficient reliability can be provided with additional monitoring of the displacement with path sensors mountable on the cylinders. Thereby, the deviation of 2% per stroke remains always the same and does not change.

The flow divider is formed of electromagnetically controlled valves. Thereby, a repeatable regulation or control per stroke is provided.

According to further features, for supplementing the basic concept, an additional function can be provided by arranging in the support points on the vertical support for the tundish with a defined load introduction, load cells as a weighing device.

Alternative thereto as a weighing device, pressure in the cylinders of the hydraulic lifting devices is measured, and the tundish weight is determined by conversion.

According to other features, the position of the tundish can be influenced by an adjusting device, which is secured on the vertical support on the fixed side and is provided on a rail side.

For further adjustment, on a rail side opposite the adjusting device, a device for cross-adjustment of the tundish is provided. Both sides are connected with each other by axial transmitting means such as e.g., rods.

For determination of displacements and forces necessary for adjustment of the tundish, the adjusting device on the loose side and a compensation device on the fixed side are connected with each other by thrust-transmitting means.

The device for cross-adjustment of the tundish engages the arms of the vertical support and is supported on the lifting device.

In the drawings embodiments of the invention are shown which will be described in detail below.

Figure 1B:
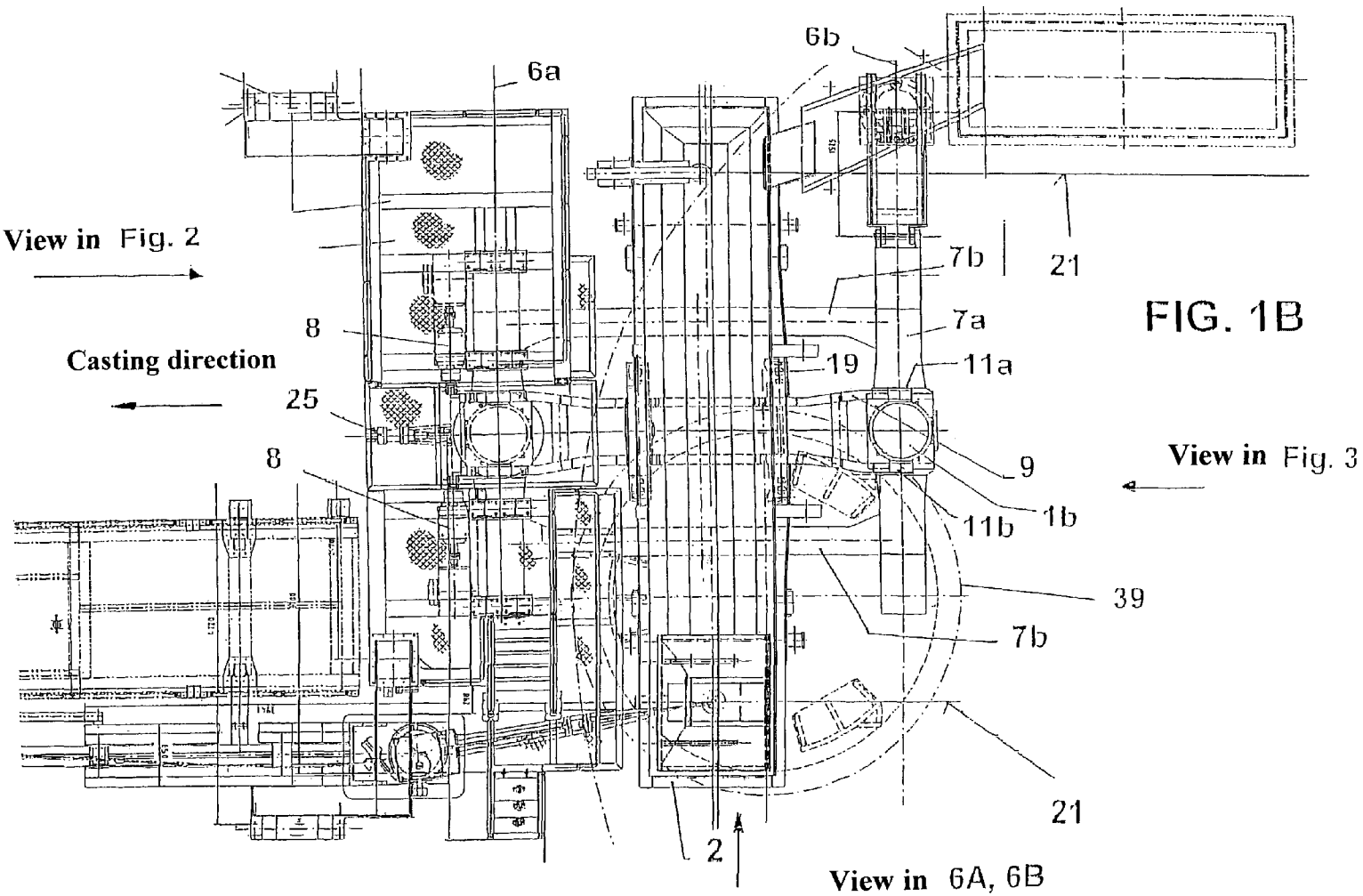
Figure 2:
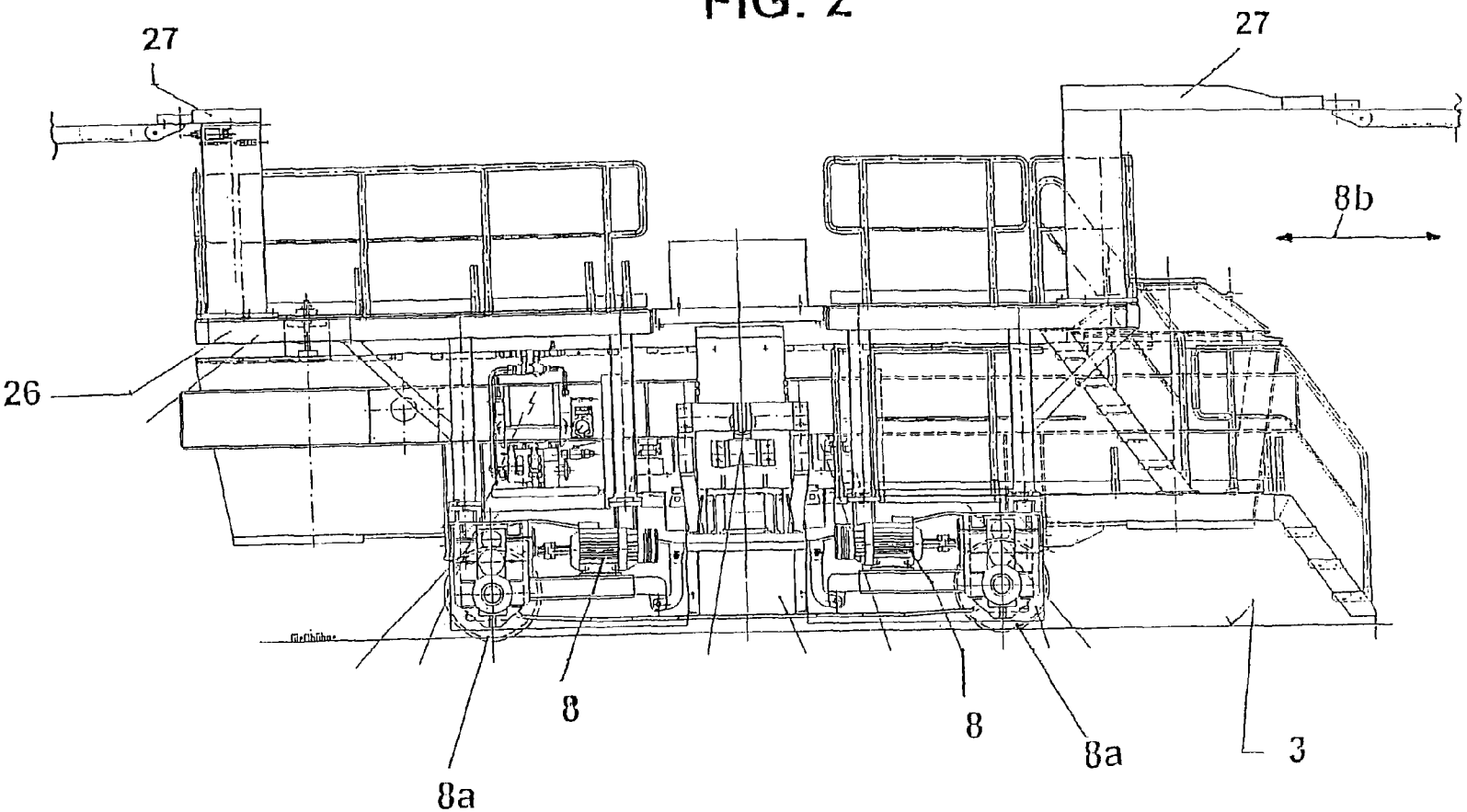
Figure 3:
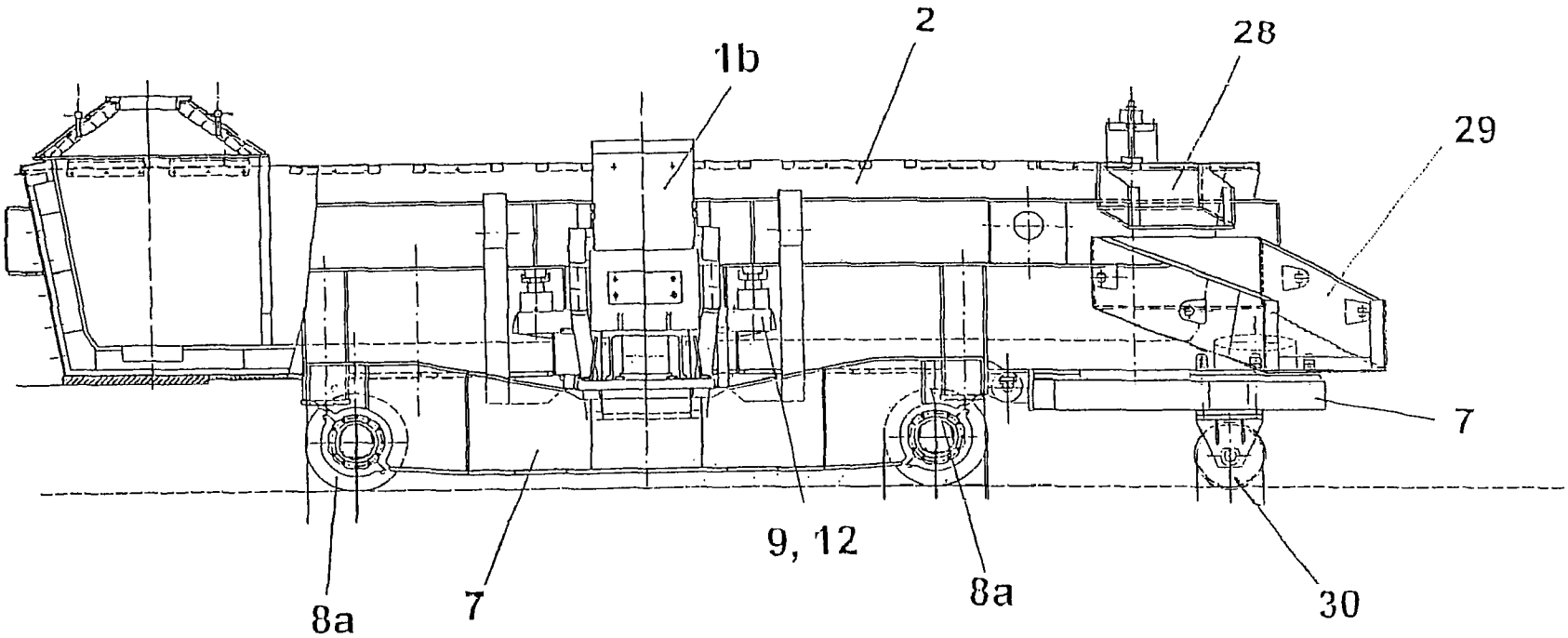
Figure 4A:
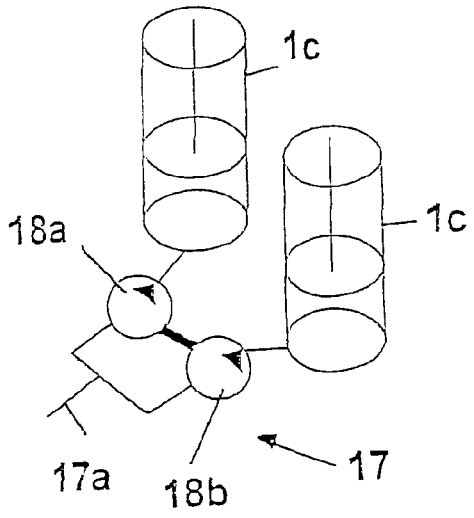
Figure 4B:
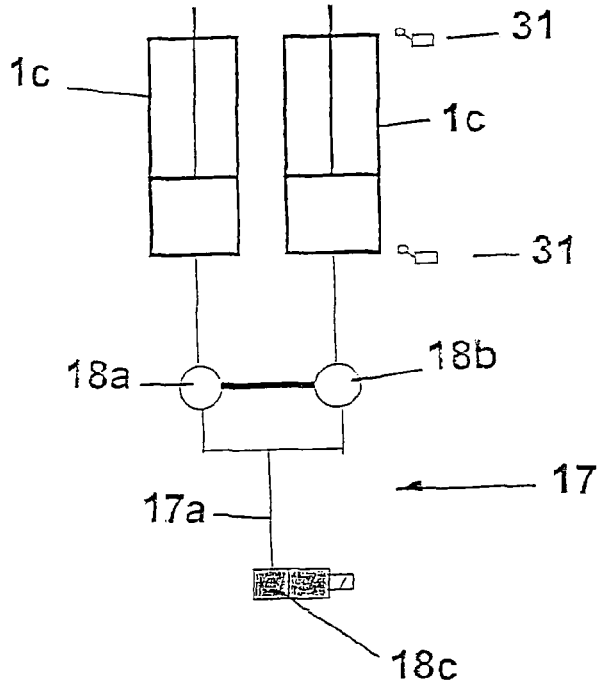
Figure 5:
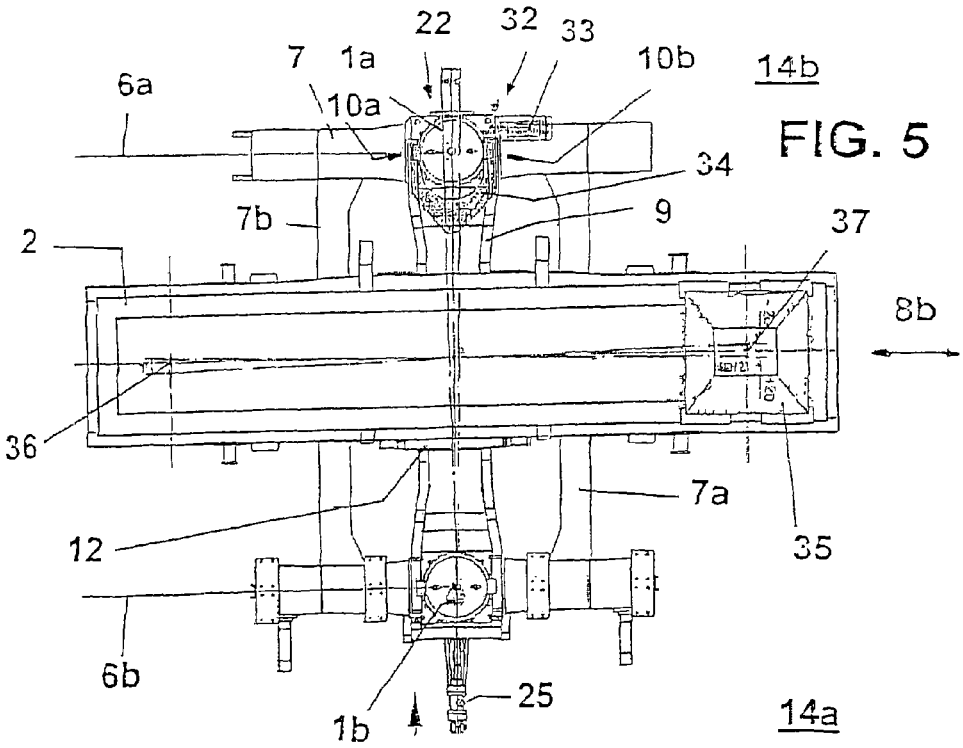
Figure 6A:
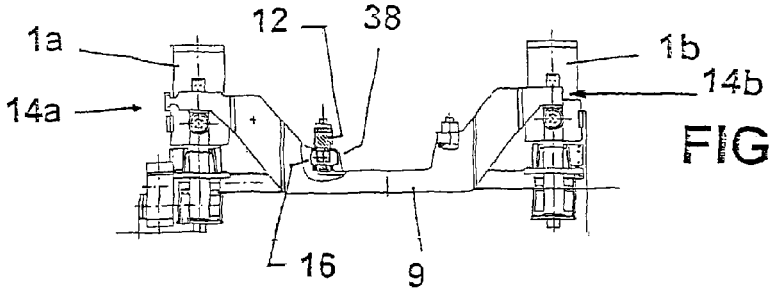
Figure 6B:
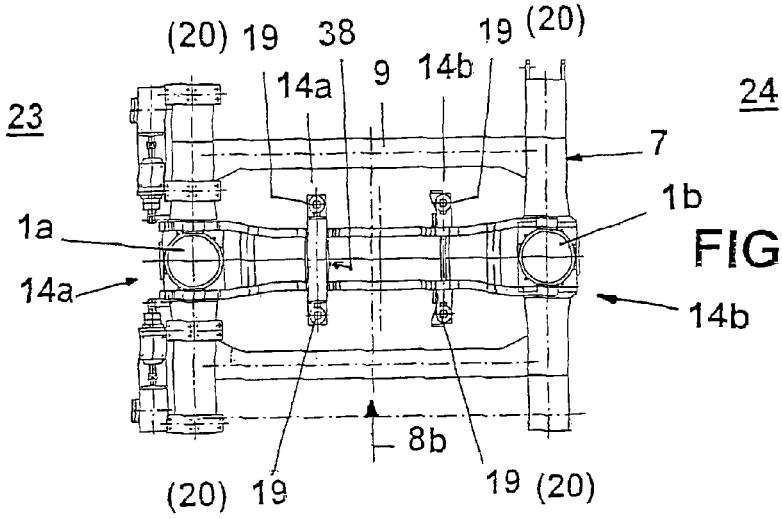
Figure 7B:
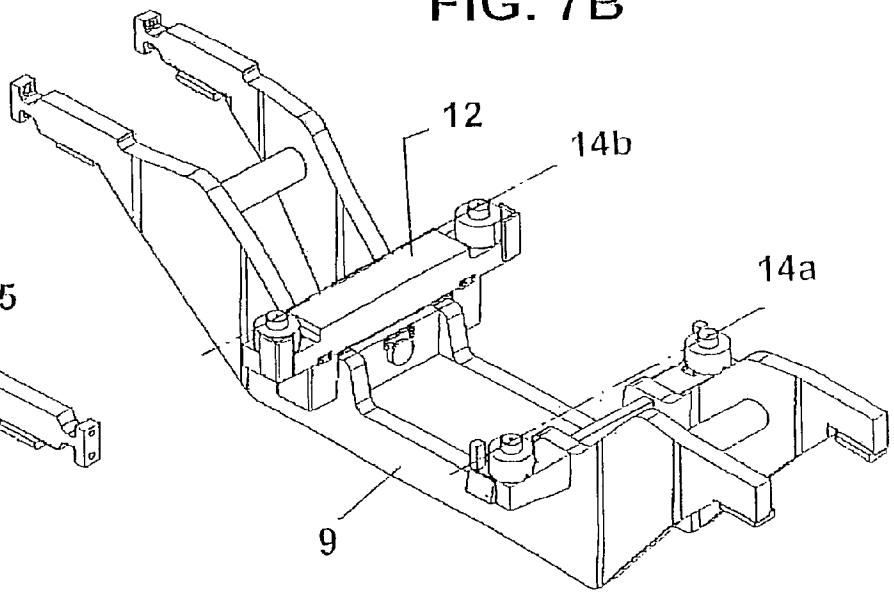
Figure 7A:
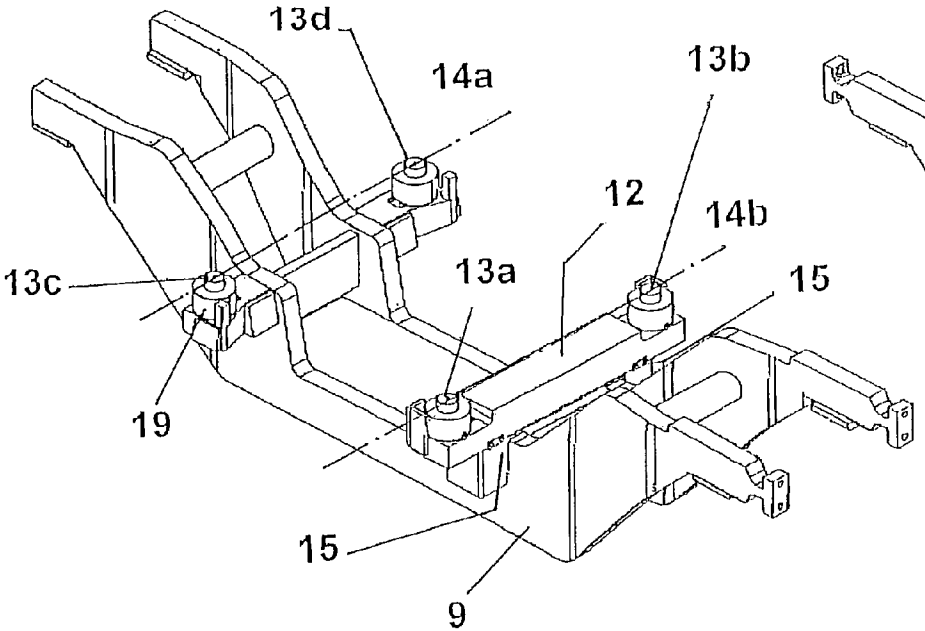
Figure 8:
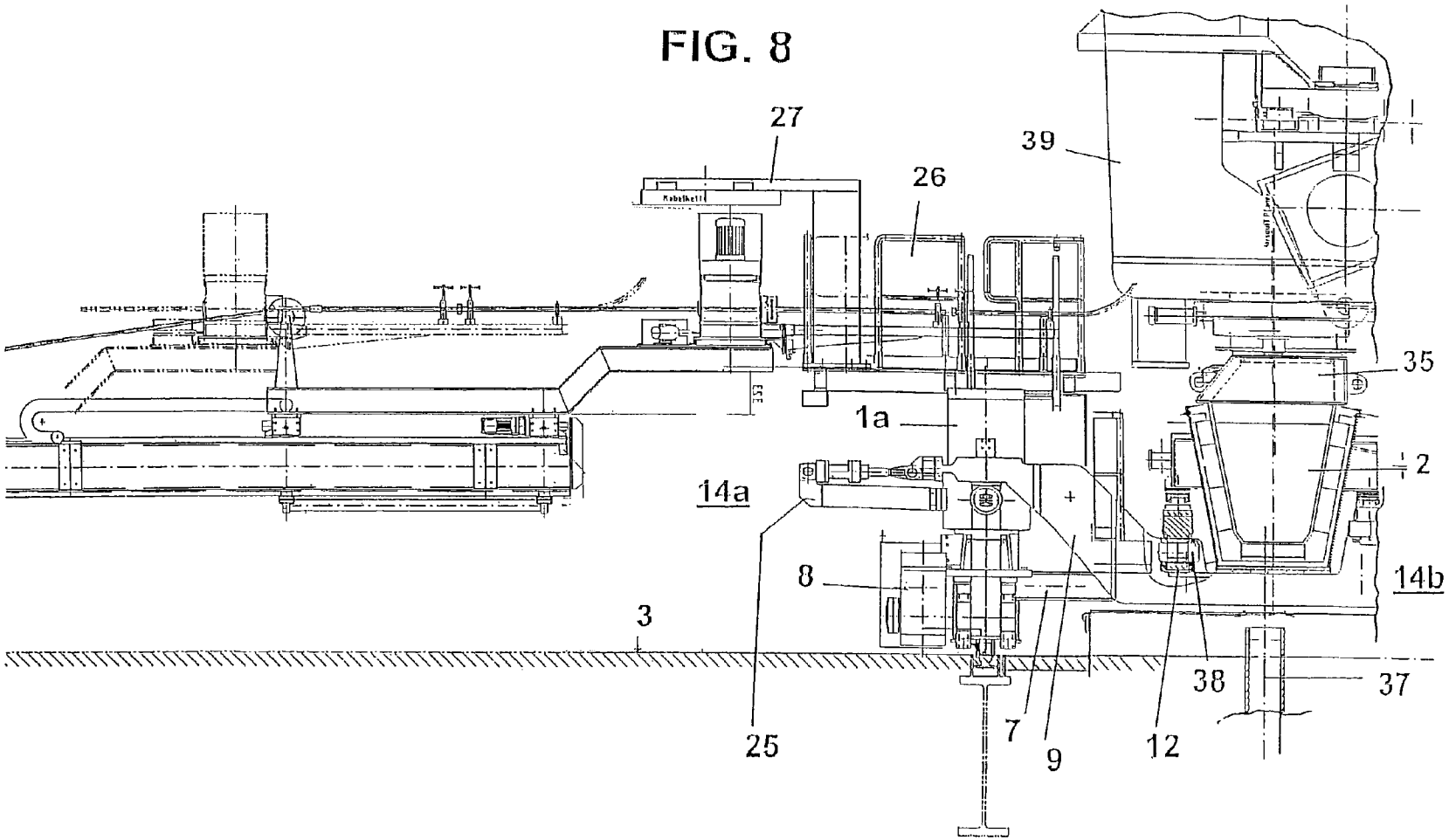

The drawings show:

FIG. 1A a simplified perspective general view of a tundish carriage displaceable on a teeming platform, without the tundish but with a tilting table;

FIG. 1B a plan view of the tundish carriage with the tundish arranged thereon;

FIG. 2 a side view of the tundish carriage in the direction shown with an arrow in FIG. 1A;

FIG. 3 a rear view of the tundish carriage with the tundish arranged thereon in the direction shown with an arrow in FIG. 1B;

FIG. 4A a principle perspective outline of a hydraulic flow divider for lifting devices;

FIG. 4B the same outline as in FIG. 4A but in a plane;

FIG. 5 a plan view of the tundish carriage with the tundish shown with the essential features for aligning of the pouring spout of a double-strand continuous caster and which extends downwardly on the tundish;

FIG. 6A a simplified view of the tundish carriage in the displacement direction with a displacement axis for the tilting table;

FIG. 6B a plan view belonging to FIG. 6A;

FIG. 7A a perspective view of the support points on the tilting table and of the fixed side for the tundish;

FIG. 7B a (reversed) perspective view as in FIG. 7A of a lifting support; and FIG. 8 a view of the tundish carriage in the displacement direction with a partial cross-section through the tilting table with the displacement axis.

A tundish carriage (FIG. 1) is equipped with a lifting device 1 for a tundish 2 and displaces on a teeming platform 3, whereby the tundish 2 is displaced on a pair of rails 6*a*, 6*b* over a continuous casting mold 4 of a continuous casting machine 5, which passes, beneath the teeming platform 3, in a back-up rolling mill stand with a cooling chamber, for liquid cast metal such as, e.g., liquid steel, and is adjusted against walls of the continuous casting mold 4 by a pouring tube that projects downward into the continuous casting mold 4 beneath the metal level. For cooling, in the continuous casting mold 4, of a cast strand that solidifies from outside inward, it is very important that the pouring tube is equidistantly spaced from the mold wall along its circumference. In the shown embodiment, the tundish 2 is supported with lifting devices 1*a*, 1*b* on a carriage frame 7 and for start of casting after a preheating, is lowered to a correct casting height into the continuous casting mold 4 and after a conclusion of a casting process that can last for hours or days, is lifted again.

Up to the present, with tundishes having electromechanical or hydraulic lifting mechanisms, lowering, adjustment and lifting again could be carried out only inadequately because of the large volume of the mechanical and/or hydraulic devices. In addition, long-lasting deformations of the tundish, which occur during an operation cannot be sufficiently compensated. Therefore, it is important that the carriage frame 7, which is provided with displacement drives 8 and running wheels 8*a* on one or both sides and is formed of longitudinal and cross-beams 7*a*, 7*b*, contains only one vertical support 9 for the tundish 2 between only two cross-beams 7*b*, which is supported with respective pairs of arms 9*a*, 9*b* on arranged in pairs, side supports 10*a*, 10*b* which are provided on both lifting devices 1*a*, 1*b* which are arranged and secured on respective longitudinal beams 7*a*, 7*a* of the carriage frame 7.

The side supports 10*a*, 10*b* of the vertical support 9 for the lifting devices 1*a*, 1*b* consist of coaxial rollers 11*a*, 11*b*. The vertical support 9 forms a loose side 14*a* (FIG. 1, left side) and a fixed side 14*b* (FIG. 1, right side). A tilting table 12, which extends in the direction of the longitudinal beam 7*a* supports the tundish 2. The function of the tilting table 12 will be described in detail below. On the vertical support 9, there are further provided support points 13*a*, 13*b*, 13*c*, and 13*d* on which the tundish 2 is supported. As it will be mentioned below with reference to FIGS. 7A and 7B, the tilting table 12, which is located on the loose side 14*a*, is supported in the vertical support 9 with compression springs (plate springs), the tilting table 12 without the tundish 2 is held horizontally and forms a compensating support 15. With the inserted tundish 2, the position compensation is effected automatically. In addition, the tilting table 12 pierces a transverse axis 16 (FIGS. 1A, 6A, 7B) which forms a displacement axis 38 and which would be mentioned and described in more details in another connection.

The tundish carriage, which is displaceable on rails 6*a* and 6*b*, can have displacement drives on one side, as shown in FIG. 1B. While the carriage frame 7, which is formed of the longitudinal beams 7*a* and cross-beams 7*b*, have, e.g., a length of 4,000 mm, the tundish 2 with a length of about 8,000 mm projects beyond it in the shown embodiment of a double-strand continuous caster (FIG. 1B). The support points 13*a* through 13*d* on the vertical support 9 can be provided either with dammy support bodies or, in case when the tundish 2 is weighted, should be provided with load cells which form a weighing device 20 (FIG. 6B). The ladle 39 is located above the tundish 2 during casting. For adjustment of the side distance of the pouring tube (see FIG. 8) relative to the walls of the continuous casting mold, the lifting device 9 is supported on the rollers 11*a* and 11*b* on the fixed side 14*b* and can be adjusted on the loose side 14*a* in a casting direction with cross-adjustment device 25.

While the view from right to left (FIG. 1B) is shown in FIG. 3, FIG. 2 (FIG. 1B) shows a view from left to right. FIG. 2 shows, in addition to the tundish carriage displaceable on the teeming platform 3 in a displacement direction 8*b* by the displacement drives 8 on the running wheels 8*a*, displaceable platforms 26 with arranged thereon cable arms 27. The cable arms 27 include conductors for electricity and conduits for necessary for operation, media (such as, e.g., hydraulic fluid, protection gas, compressed air, etc.).

FIG. 3 (view from left to right in FIG. 1), shows, in addition to the hydraulic lifting device 1*b*, the tundish 2, in addition, an overflow nozzle 28 and an overflow spout 29 which adjoins the tundish 2, wherein in addition to the running wheels 8*a* on the carriage frame 7, the attached frame 7 for the overflow spout 29 runs on one of the rails 6*a* or 6*b* using a support wheel 30.

In order to replace disadvantageous, expensive and laborious synchronization regulation or control, according to FIGS. 4A and 4B, there is provided, for both available hydraulic lifting devices 1*a* and 1*b* with cylinders 1*c*, a flow divider 17 connected with a feeding conduit 17*a* and formed of control valves 18*a* and 18*b*, wherein both control valves 18*a* and 18*b* are controlled by a controllable electromagnetic valve 18*c*. The control resolution amounts to about ±2% which at a stroke of about 650 mm, comes to 26 mm, insuring a great reliability and a clearer conception with a greater cost-effectiveness than the conventional synchronization control with large electronic and switching costs. Stroke monitoring can be carried out with two displacement sensors 31 which are adequate for sensing reliably displacement in the cylinder 1*c*.

FIG. 5 shows the tundish 2 on the carriage frame 7 with the longitudinal beams 7*a* and cross-beams 7*b* and which is displaceable on the rails 6*a*, 6*b*. The tundish carriage serves a double-strand continuous caster 21, wherein both strands are characterized by midpoint 3*b* (strand 1) and midpoint 37 (strand 2). The ladle 39 (not shown there) finds itself above a protective runner-box 35. An adjustment device 22 is located on the fixed side 14*b*. A cross-adjustment device 25 is located on the loose side 14*a*. The adjustment 22 is thus located, in the double-strand continuous caster 21, on a rail side 23 and is attached to the lifting device 1*a*. The adjusting device 22 is used in particular with a double-strand tundish 2 and serves for aligning the pouring tube in the midpoint 37 of the cast strand 2, i.e., in the continuous casting mold 4 for compensating support tolerances and spout deformations. There is further provided a compensation device 32 having an adjustment stirrup 34 supported on the vertical support 9 and against the lifting device 1a and adjustable, within certain limits, by a pivot cylinder 33. The retention of the tilting table 12 is effected with a cross-axle 16 secured on the vertical support 9. The adjustment stirrup 34 is connected with the vertical support 9. Thus, the complete vertical support 9 can be pivoted and, thereby also the tundish 2, i.e., the transfer is effected over the loose side 14*a* (tilting table 12) and the fixed side (14*b*). This re-adjustment is advantageous for tundishes that operate for a long time and a position of which has been changed somewhat by deformation of the brick lining. The cross-adjusting device 25 displaces the vertical support 9 transverse to the displacement direction 8*b* in opposite directions. The cross-adjusting device 25 is provided on a rail side 24 located opposite the adjusting device 22 for cross-adjustment of the tundish 2. The device 25 for cross-adjusting of the tundish adjoins the arms 9*a*, 9*b* of the vertical support 9 and is supported against the lifting device 9 (actually the lifting device 1*b*—Translator's remark).

FIG. 6A shows the hydraulic devices 1*a*, 1*b* and a connecting them, vertical support 9 defining the loose side 14*a* and the fixed side 14B, and the tilting table 12 that extends transverse to the vertical support 9. The tilting table 12 is supported on the cross-axle 16 secured in the vertical support 9. In FIG. 6B that shows the tundish carriage without the tundish 2, the adjusting device 22, and the cross-adjusting device 25, in addition to the loose sides 14*a* of the lifting devices 1*a*, 1*b* and in addition to the fixed sides 14*b*, the load cells 19 are shown which form a weighing device 20, in case such is considered to be appropriate at this point. As the weighing device, the fluid pressure, which prevails in the cylinders 1*c* of the lifting devices 1*a*, 1*b*, can be measured and lead to a conclusion regarding the tundish weight in the course of conversion. In this case, the load cells 19 can be replaced by dammy pieces of equal shape and dimensions.

FIGS. 7A and 7B show the vertical support in perspective and separately, without the surrounding it, components. On the fixed side 14*b* and the loose side 14*a*, in case of provision of the weighing device 20, the load cells 19, which form the same, are shown. The tilting table 12 is displaceable in the vertical support 9 and is supported against a springy support 15. The vertical support 9, which is formed of two side walls and cross-streets, has, for the springy support 15 (that can consist of compression springs or plate spring packages), a necessary angle-shaped recess that can also be clearly seen in FIG. 1A. In FIG. 7B, the vertical support 9, together with the tilting table 12, is shown from the opposite direction.

FIG. 8 shows a partially cross-sectional, transverse to the displacement direction, view of the tundish carriage in the operational position. On the teeming platform 3, the tundish carriage is brought in a position by the displacement drive 8 and is secured there. After lowering of the preheated tundish 2 with the submerging outlet, the midpoint 37 of the strand 2 becomes submerged. With the increase of an operational time, the tilting table 12 serves for compensation of the mentioned sprout deformations. The adjustment and, thereby, subsequent readjustments of the tundish 2 is effected with the cross-adjusting device 25 and the adjustment device 22.

The displacement axis 38 of the tilting table 12 can be seen. A filled ladle 39 is displaced over the runner-box 35, and the discharge can begin.

In the tundish carriage, the accompanying platforms 26 and the cable arms can be recognized. The adjusting processes can be effected from the accompanying platform 26 with the lifting device 1*a* and the cross-adjusting device 25 located adjacent thereto.

LIST OF REFERENCE NUMERALS

1 Lifting device
1*a* (hydraulic) Lifting device
1*b* (hydraulic) Lifting device
1*c* Cylinder
2 Tundish
3 Teeming platform
4 Continuous casting mold
5 Continuous casting machine
6*a* Rail
6*b* Rail
7*a* Longitudinal beam
7*b* Cross-beam
8 Displacement drive
8*a* Running wheel
8*b* Displacement direction
9 Vertical support
9*a* Arm
9*b* Arm
10*a* Support on the lifting device
10*b* Support on the lifting device
11*a* Roller
11*b* Roller
12 Tilting table
13*a* Support point in the vertical support
13*b* Support point in the vertical support
13*c* Support point in the vertical support
13*d* Support point in the vertical support
14*a* Loose side
14*b* Fixed side
15 Compensation support
16 Cross-axle
17*a* Feeding conduit
18*a* Electromagnetic control valve
18*b* Electromagnetic control valve
18*c* Controllable electromagnetic valve
19 Load cell
20 Weighing device
21 Double-strand continuous caster
22 Adjusting device
23 (left) rail side
24 (right) rail side
26 Accompanying platform
27 Cable arm
28 Overflow nozzle
29 Overflow spout
30 Support wheel for the tundish
31 Displacement sensor
32 Compensation device
33 Pivot cylinder
34 Adjusting stirrup
35 Runner-box
36 Midpoint cast strand 1
37 Midpoint cast strand 2
38 Displacement axis for the tilting table
39 Ladle

The invention claimed is:

1. A tundish carriage displaceable on a teeming platform (3) located above a continuous casting mold (4) of a continuous casting machine (5) on a pair of rails (6*a*, 6*b*), the tundish carriage comprising a pair of lifting devices (1*a*, 1*b*) for supporting a tundish (2) with a possibility of lifting and lowering the tundish; and a frame (7) on which the lifting devices are supported, Wherein the frame (7) is formed of longitudinal and cross-beams (7*a*, 7*b*) and includes displacement drives (8) provided on at least one of opposite sides of the frame (7), a vertical support (9) for the tundish (2) and located between the cross-beams (7*b*), two, spaced from each other, side supports (10*a*, 10*b*) arranged on respective lifting devices (1*a*, 1*b*) secured on respective longitudinal beams (7*a*, 7*a*), and a pair of arms (9*a*, 9*b*) provided on respective side supports (10*a*, 10*b*) for supporting the vertical support (9).

2. A tundish carriage according to claim 1, wherein the side supports (10*a*, 10*b*) are formed of coaxial rollers (11*a*, 11*b*).

3. A tundish carriage according to claim 1, wherein the lifting device (1*a*, 1*b*) is formed by a hydraulic piston-cylinder unit, the side supports (10*a* 10*b*) being provided on a respective cylinder housing.

4. A tundish carriage according to claim 1, further comprising a longitudinally displaceable tilting table (12) for the tundish (2) supported in the vertical support (9) on a loose side (14*a*) of the vertical support, the vertical support (9) having two symmetrically arranged pairs of support points (13*a*- 13*d*) for the tundish (2).

5. A tundish carriage according to claim 4, wherein the tilting table (12) is supported in the vertical support (9) with a compensation support (15).

6. A tundish carriage according to claim 4, wherein the tilting table (12) is supported in the vertical support (9) for a pivotal movement about a cross-axle (16) extending parallel to the cross-beams (7*b*).

7. A tundish carriage according to claim 1, comprising a hydraulic flow divider (17) for connecting the hydraulic lifting devices (1*a*, 1*b*) to a common feeding conduit (17*a*).

8. A tundish carriage according to claim 7, wherein the flow divider (17*a*) is formed of electromagnetically controlled valves (18*a*, 18*b*).

9. A tundish carriage according to claim 4, wherein the support points (13*a*-13*d*) are provided with load cells (19) forming a weighing device (20).

10. A tundish carriage according to claim 3, wherein the tundish weight is determined by measuring pressure in a hydraulic cylinder (1*e*) and a subsequent conversion.

11. A tundish carriage according to claim 1, comprising an adjusting device (22) secured on a fixed side (14*b*) of the vertical support (9) and provided on one rail side (23).

12. A tundish carriage according to claim 11, wherein on a rail side (24) opposite the adjusting device (22), a device for cross-adjustment of the tundish (2) is provided.

13. A tundish carriage according to claim 1, comprising an adjusting device (22) on the loose side (14*a*), a compensation device (32) on the fixed side (14*b*), and thrust-transmitting means for connecting the adjusting and compensation devices.

14. A tundish carriage according to claim 12, wherein the device (25) for cross-adjustment of the tundish (2) engages the arms (9*a*, 9*b*) of the vertical support (9) and is supported on the lifting device (1*a*; 1*b*).

* * * * *